US008651921B2

(12) United States Patent
Clark et al.

(10) Patent No.: US 8,651,921 B2
(45) Date of Patent: Feb. 18, 2014

(54) SURFACE TREATMENT DEVICE

(75) Inventors: Daniel Clark, Belper (GB); Stephen John Tuppen, Swadlincote (GB)

(73) Assignee: Rolls-Royce PLC, London (GB)

( * ) Notice: Subject to any disclaimer, the term of this patent is extended or adjusted under 35 U.S.C. 154(b) by 325 days.

(21) Appl. No.: 13/148,407

(22) PCT Filed: Feb. 3, 2010

(86) PCT No.: PCT/EP2010/000637
§ 371 (c)(1),
(2), (4) Date: Sep. 26, 2011

(87) PCT Pub. No.: WO2010/091812
PCT Pub. Date: Aug. 19, 2010

(65) Prior Publication Data
US 2012/0071069 A1 Mar. 22, 2012

(30) Foreign Application Priority Data
Feb. 13, 2009 (GB) ..... 0902333.4

(51) Int. Cl.
*B24B 7/00* (2006.01)

(52) U.S. Cl.
USPC ..... 451/163; 451/165; 451/344; 451/527; 451/532; 451/910; 15/106

(58) Field of Classification Search
USPC ..... 451/36, 59, 163, 164, 165, 168, 344, 451/490, 526, 527, 532, 910; 15/106, 107
See application file for complete search history.

(56) References Cited

U.S. PATENT DOCUMENTS

| | | | | |
|---|---|---|---|---|
| 5,888,002 | A * | 3/1999 | Fenstersheib | 401/28 |
| 6,106,368 | A | 8/2000 | Childers et al. | |
| 6,183,353 | B1 | 2/2001 | Frantzen | |
| 6,454,633 | B1 * | 9/2002 | Reinhardt et al. | 451/36 |
| 2004/0194237 | A1 | 10/2004 | Walton | |
| 2008/0119115 | A1 | 5/2008 | Haneda et al. | |
| 2010/0124729 | A1 * | 5/2010 | Liao et al. | 433/80 |
| 2011/0048457 | A1 * | 3/2011 | Dean et al. | 134/6 |
| 2013/0149945 | A1 * | 6/2013 | Misra | 451/540 |

FOREIGN PATENT DOCUMENTS

| | | |
|---|---|---|
| DE | 10 2006 058 679 | 6/2008 |
| GB | 2 288 350 A | 10/1995 |
| WO | WO 96/33638 | 10/1996 |
| WO | WO 02/10462 A1 | 2/2002 |

OTHER PUBLICATIONS

Aug. 10, 2010 International Search Report in related International Appln. No. PCT/EP2010/000637.

* cited by examiner

*Primary Examiner* — Eileen P. Morgan
(74) *Attorney, Agent, or Firm* — Oliff PLC

(57) ABSTRACT

A surface treatment device includes an enclosure which has an opening through which the leading edge of an aerofoil passes. A sealing element is provided on the enclosure to seal the device to the surfaces of the aerofoil. An abrasive is located within the enclosure and two fluid openings are also provided through which a chemical accelerant can be pumped. In operation the enclosure is oscillated relative to the component so that material is abraded. Whilst the enclosure is oscillated a chemical accelerant is simultaneously pumped through it. The device allows for the local application of a surface treatment on a component.

14 Claims, 4 Drawing Sheets

SURFACE TREATMENT DEVICE

Figure 2:
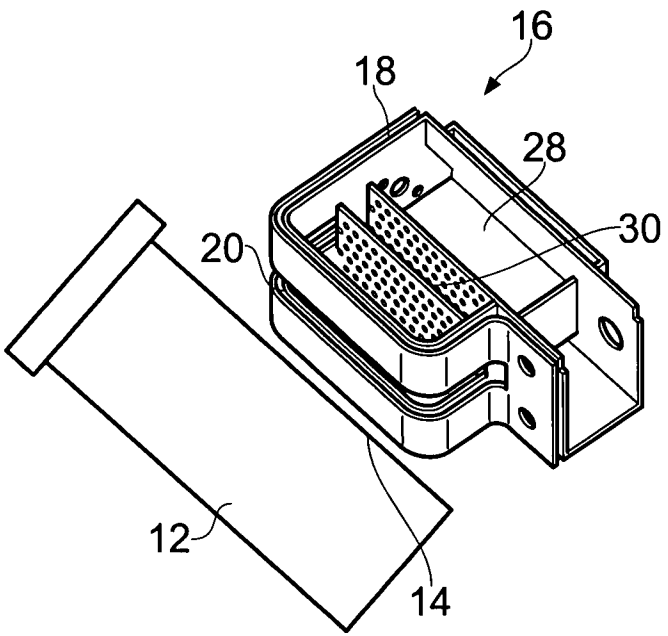

The present invention relates to a surface treatment device. In particular it relates to a surface treatment device which uses both an abrasive media and a chemical accelerant to polish a surface.

The surfaces of components, such as blades, within a gas turbine engine have to be finished to within a high degree of accuracy to attain the necessary aerodynamic performance. Polishing of these complex surfaces is difficult and a number of different techniques are used. These include the use of abrasive media in the form of clothes or wheels, ultrasonic oscillation, electro-chemical polishing and vapour blasting.

A further polishing technique which is widely used on complex aerospace components is chemical vibro-polishing. With this polishing technique a chemical accelerant is used in combination with a mechanical interaction to achieve the desired surface finish. One way in which this can be achieved is to place the component in a processing tank with an abrasive media and vibrate it. The abrasive particles gently abrade the surface of the component without substantially deforming the component. A chemical accelerant is introduced in liquid form and changes the state of the surface resulting in a change in the coefficient of friction such that the surface becomes more susceptible to abrasive wear.

Difficulties with this technique are that the component must be removed from an assembly and the surface of the whole component is abraded. Polishing of the whole surface may lead to thinning in key locations such as the leading edge of an aerofoil of a blade. This process is therefore unsuitable if the component has delicate surfaces that could be damaged by either the abrasive of the chemical accelerant. As the whole component is treated large amounts of both the abrasive media and the chemical accelerant are required. As well as the increased cost there are environmental issues around the handling and disposal of the chemical accelerant so excessive use of chemical accelerants is to be avoided.

The present invention seeks to provide a surface treatment device which overcomes the aforementioned problems and which enables an abrasive and a chemical accelerant to be preferentially applied to parts of a component requiring a polishing treatment.

According to the present invention a surface treatment device comprises an enclosure characterised in that within the enclosure an abrasive in the form of hollow bristles is located, the enclosure having an opening which engages with at least one surface of a component so that the abrasive is in contact with the surface, means being provided to oscillate the abrasive, wherein fluid means are provided to direct a flow of fluid through the hollow bristles and into the enclosure, a seal being provided adjacent the opening in the enclosure to prevent egress of the fluid.

Preferably the fluid passing through the enclosure is a chemical accelerant which assists in the abrasion of the surface of the component. The chemical accelerant affects the surface of the component to that the surface becomes more susceptible to abrasive wear. The chemical accelerant may be a nitric acid solution which breaks down oxides on the surface to allow etching.

In the preferred embodiment of the present invention the seal is resilient so that in operation the enclosure is held in sealing relationship with at least one surface of the component. The resilient seal may be made from an elastomer based compound and may be solid or hollow. The hollow seal may be inflatable. An advantage of an inflatable seal is that it can conform more accurately to the surface on which it seals.

In one embodiment of the present invention the enclosure is designed to fit around an edge of the component and seals against two surfaces adjacent the edge.

Preferably the abrasive is mounted on tracks within the enclosure. The tracks and the bristles may oscillate or rotate within the enclosure.

The bristles may have a further abrasive media applied to them and may be of different lengths and have different stiffness. The arrangement, contour and pattern of the bristles can be adapted to the contour of the component and will depend upon the specific polishing application.

A probe may also be provided within the enclosure to monitor the wear of the bristles within the enclosure and/or the surface finish on the surface of the component.

Ultrasonic vibration may also be applied to the cassette to assist the vibro-polishing process.

Figure 1:
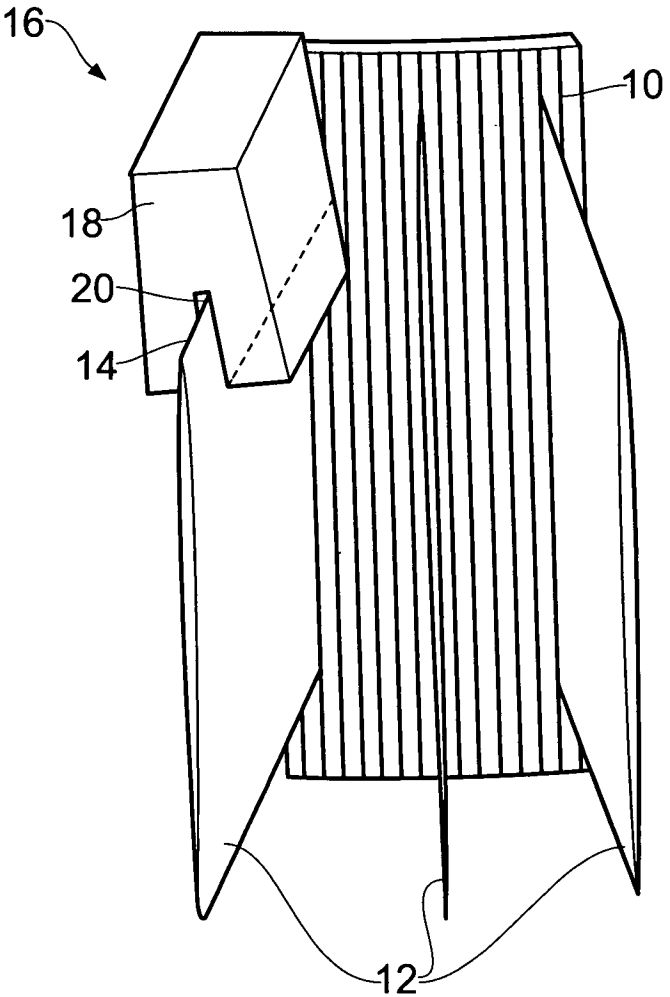

The present invention will now be described with reference to the accompanying figures in which;

FIG. 1 is a schematic view of a surface treatment device in accordance with one embodiment of the present invention and is shown in use on the leading edge of an aerofoil.

Figure 3:
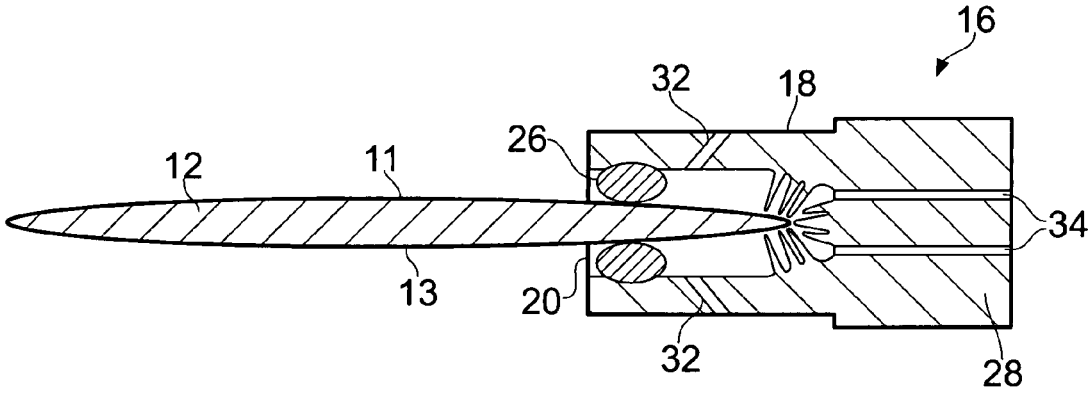
Figure 4:
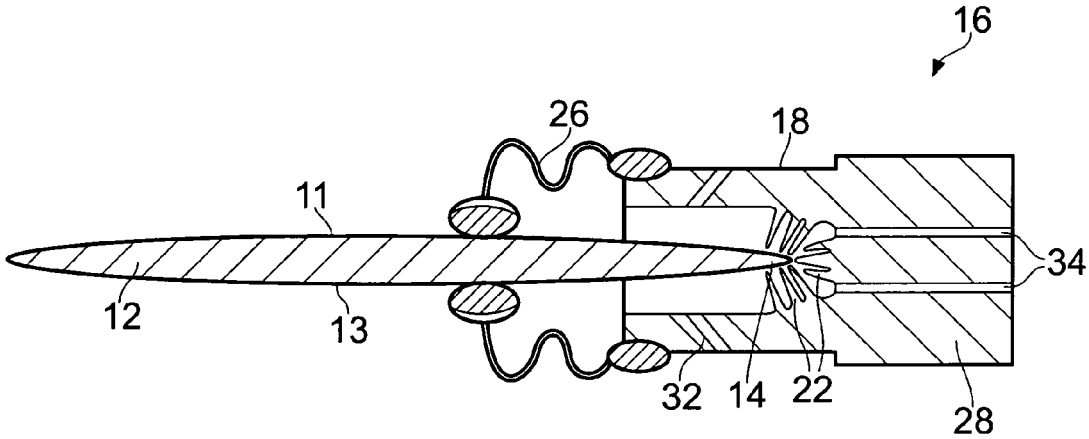
Figure 5:
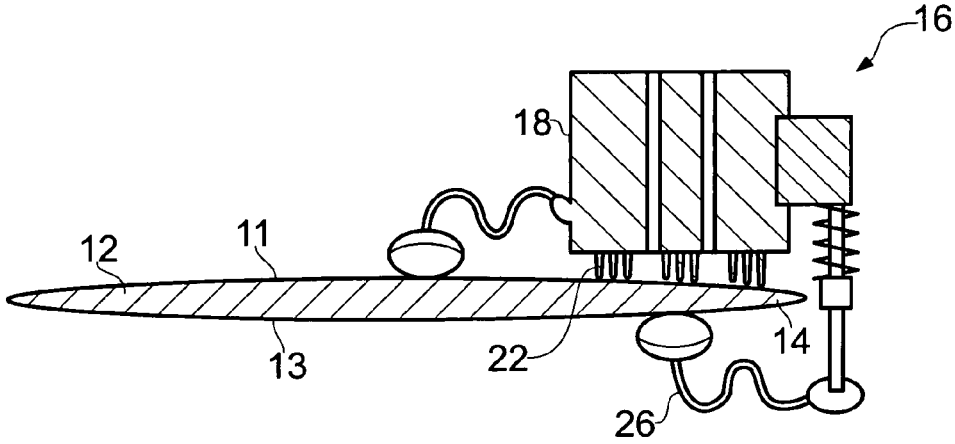
Figure 6:
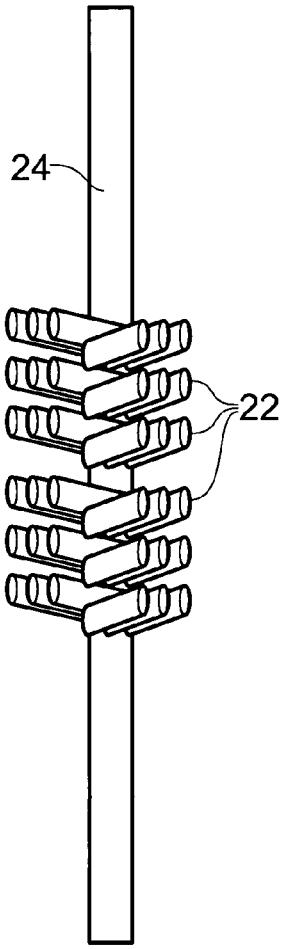
Figure 7:
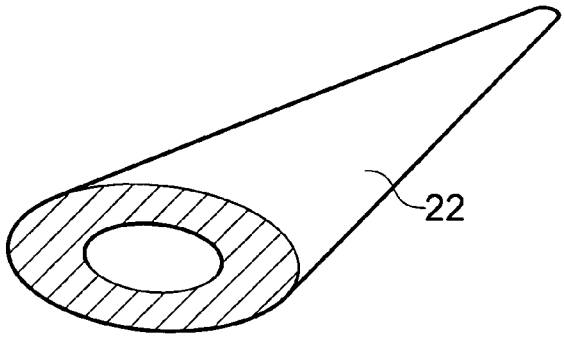
Figure 8:
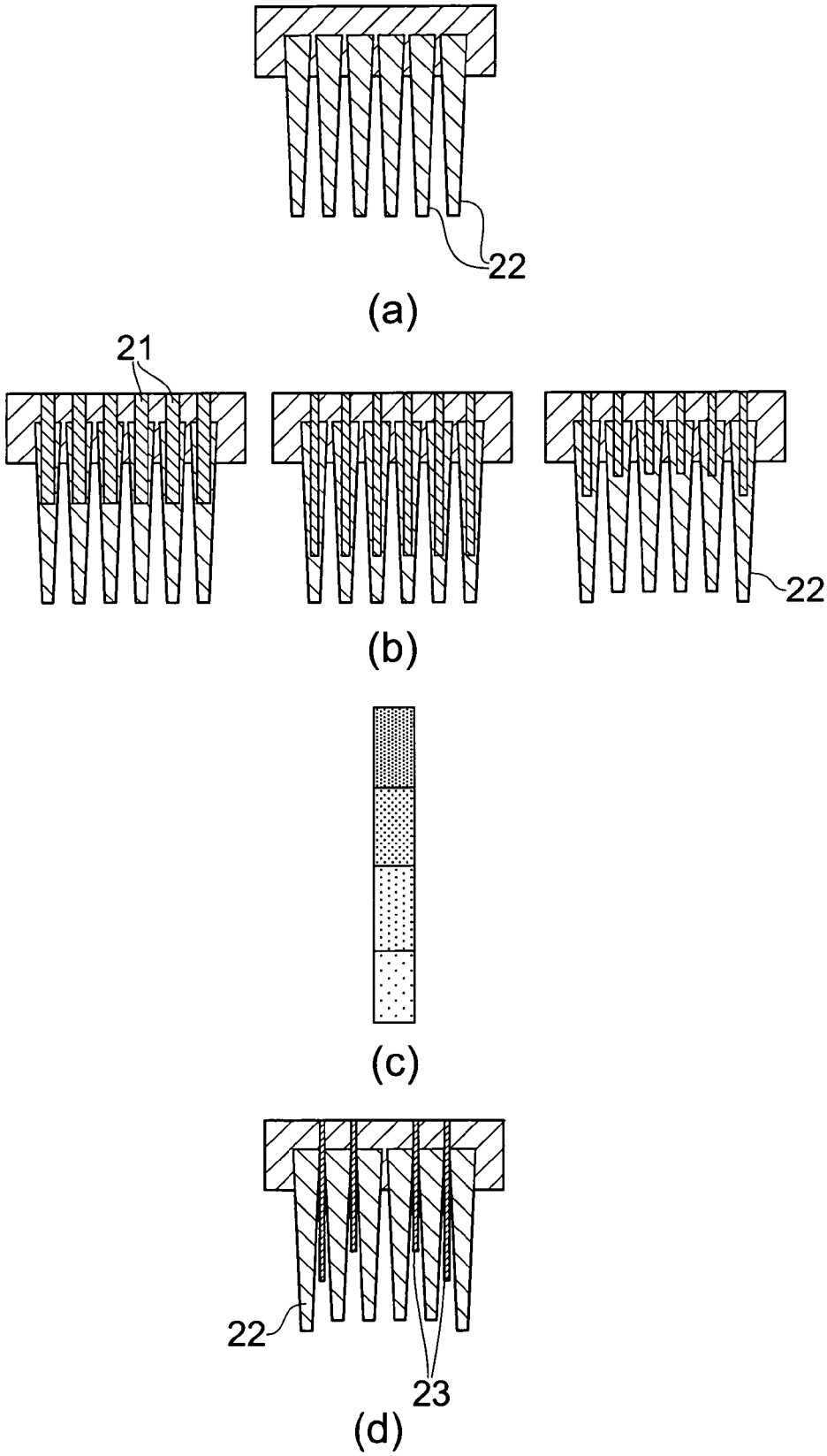

FIG. 2 is an exploded view of the surface treatment device shown in FIG. 1; and FIG. 3 is a cross-sectional view of a surface treatment device having an "O" ring seal arrangement; and FIG. 4 is a cross-sectional view of a surface treatment device having which utilizes a different seal arrangement; and FIG. 5 is cross-sectional view of a surface treatment device in accordance with a second embodiment of the present invention; and FIG. 6 is a schematic view of one arrangement of bristles used in surface treatment devices in accordance with the present invention; and FIG. 7 is a sectional view of a hollow bristle; and FIGS. 8*a-d* are views of different bristle arrangements.

In accordance with the present invention a surface treatment device 16 is designed to engage with at least one surface of a component 12. The component 12, FIG. 1, is one of a number of aerofoils mounted on a disc 10. The aerofoils 12 are an integral part of the disc 10 and the device 16 is mounted on an edge 14 of the aerofoil 12.

The surface treatment device 16 comprises an enclosure 18 which has an opening 20 through which an edge 14 of the aerofoil 12 passes. A plurality of bristles 22, shown in FIG. 6, are mounted on rails 24 and are located within the enclosure 18. Sealing elements 26, shown in FIGS. 3-5, are provided on the enclosure 18 to seal the device 16 to the surfaces 11 and 13 adjacent the edge 14 of the aerofoil 12 that is to be treated.

Within the enclosure 18, FIG. 2, are a fluid processing head 28 and anchoring features 30 for location of the rails 24 holding the bristles 22. Two fluid inlets 32 are also provided in the enclosure 18, shown in FIGS. 3 and 4, through which a chemical accelerant can be pumped.

In operation the enclosure 18 is oscillated relative to the component 12 so that the bristles abrade material at edge 14 and from the adjacent surfaces 11 and 13. Whilst the enclosure 18 is oscillated a chemical accelerant is simultaneously pumped through it. The chemical accelerant passes through the fluid inlets 32, past the array of bristles 22 and through the processing head 28. As the enclosure 18 is sealed against surfaces 11 and 13 all the spent fluid, which contains any abraded material, can be exhausted from the enclosure 18 through the fluid outlets 34 under negative pressure.

A further embodiment of the present invention is shown in FIG. 5. In this embodiment the enclosure 18 is designed to abrade material on a single surface 11. Pressure is applied via a gimbled or ball joint (not shown) to ensure that the bristles 22 remain in contact with the surface 11 which is to be treated. The device 16 is once again sealed to the surface 11 to ensure that any spent fluid and abraded material passes though the processing head and out of the enclosure 18.

It will be appreciated by appreciated by one skilled in the art that a variety of different seals and abrasives may be used within the enclosure.

The seals on the enclosure 18 must however be sufficiently resilient so that they can compensate for the oscillation of the enclosure 18 and for any variations in the profile of the surfaces 11 and 13 against which they seal. In the embodiment shown in FIG. 3 the sealing element 26 is shown as an "o" rings located within the opening 20 of the enclosure 18. However in FIG. 4 an elastomeric seal is held in place by a bellows clips. The bellows clip extends outwards from the opening 20 in the enclosure and is sufficiently flexible that it can extend around more complex geometries. These elastomeric seals are solid however hollow seals may be used which can be inflated. Inflatable seals offer the further advantage that they are more compliant and can conform more accurately to complex surface profiles.

It is further envisaged that different abrasives may be used depending on the particular application of the device 16. The abrasive media may also be fixed within the enclosure 18 or may move or rotate relative to the enclosure 18. Movement of the abrasive media relative to the enclosure 18 facilitates optimum alignment between the abrasive media and the surface to be treated enabling more complex geometries to be treated.

In the embodiments shown the abrasive media used are bristles 22. The bristles 22 can take various forms but are preferably made from an inert organic compound which is soft relative to the surface of the component 12. A further abrasive media is carried by the bristles 22. The further abrasive can either be bonded to the tips of the bristles 22 or is carried in the form of a slurry or paste. The bristles 22 provide the energy to work the abrasive media against the surface to remove a controlled amount of material.

The bristles 22 could be manufactured from glass fibre and have rounded ends. Ceramic particles, harder than the substrate yet chemically inert with both the substrate of the component 12 and the chemical accelerant, could be embedded in the bristles or entrained throughout. For example ceramic particles of silica, zirconia, alumina or yttria for example are suitable and could be used.

Different arrangements, contours and patterns of bristles 22 can be used depending on the contour of the component 12 to be treated. The bristles 22 may have different lengths and vary in stiffness and this can be achieved in a variety of different ways. For example the diameter of the bristles may change with respect to length, FIG. 8*a*. The bristles may be internally reinforced either by the use of a second material 21, FIG. 8*b* or by changing the density of the material forming the bristle, FIG. 8*c*. Supplemental support structures 23 located adjacent to the bristles 22 could be used FIG. 8*d* or the bristles could be bundled, twisted or clustered and made into helical or strip brushes. The fibres are hollow as shown in FIG. 7 to grade their flexibility or to deliver a liquid media to the treatment area.

Chemical accelerants suitable for use in the present invention are well known and the accelerant used will depend on the specific application of the device. For application on titanium aerospace components a nitric acid solution is preferred which breaks down any oxides on the surface to allow etching. However the chemical accelerant does not necessarily have to be acidic if the surface oxides can be chemically converted to a more friable form such as a hydroxide.

Ultrasonic vibration may be applied to the cassette to assist with the vibro-polishing and a probe (not shown) may also be incorporated within the enclosure 18. The probe is preferably a depth probe and is used to monitor either the amount of wear on the bristles 22 or the surface finish on the component 12 or both.

A surface treatment device 16 in accordance with the present invention offers the advantage that the abrasive media and the chemical accelerant required in vibro-polishing can be applied preferentially to the areas of the component 12 requiring treatment. In this way a local area can be treated without damaging adjacent surfaces. This is particularly beneficial when an original component 12 is repaired and polishing is only required in the vicinity of the repair. The sealed enclosure 18 also ensures that a controlled amount of the abrasive and of the chemical accelerant can be applied to the area requiring treatment avoiding the use of excessive amounts of either. Use of such a device 16 ensures that vibro-polishing is carried out in a controlled environment and allows the chemical accelerant to be recirculated minimising any hazard to the operator and the environment.

The invention claimed is:

1. A surface treatment device comprising an enclosure wherein within the enclosure an abrasive in the form of hollow bristles is located, the enclosure having an opening which engages with at least one surface of a component so that the abrasive is in contact with the surface, means being provided to oscillate the abrasive, wherein fluid means are provided to direct a flow of fluid through the hollow bristles and into the enclosure, a seal being provided adjacent the opening in the enclosure to prevent egress of the fluid.

2. A surface treatment device as claimed in claim 1, wherein the fluid is a chemical accelerant which assists in the abrasion of the surface of the component.

3. A surface treatment device as claimed in claim 1, wherein the seal is solid.

4. A surface treatment device as claimed in claim 1, wherein the seal is hollow.

5. A surface treatment device as claimed in claim 4, wherein the hollow seal is inflatable.

6. A surface treatment device as claimed in claim 1, wherein the enclosure fits over an edge of a component and seals on the surfaces adjacent that edge.

7. A surface treatment device as claimed in claim 1, wherein the bristles are mounted on rails which oscillate or rotate relative to the enclosure.

8. A surface treatment device as claimed in claim 1, wherein the bristles vary in length.

9. A surface treatment device as claimed in claim 1, wherein the bristles vary in stiffness.

10. A surface treatment device as claimed in claim 7, wherein the stiffness of the bristles vary with length.

11. A surface treatment device as claimed in claim 10, wherein the bristles are reinforced.

12. A surface treatment device as claimed in claim 11, wherein the reinforcement is provided internally of the bristles.

13. A surface treatment device as claimed in claim 1, further comprising a depth probe.

14. A surface treatment device as claimed in claim 1, wherein means are provided in the enclosure to produce ultrasonic vibrations which assist in the abrasion of the surface of the component.

* * * * *